United States Patent [19]

Smith

[11] Patent Number: 4,538,497

[45] Date of Patent: Sep. 3, 1985

[54] SOFT BODY GUITAR

[76] Inventor: Walter E. Smith, P.O. Box 707, Weiser, Id. 83672

[21] Appl. No.: 446,184

[22] Filed: Dec. 2, 1982

[51] Int. Cl.[3] ..... G10D 1/08

[52] U.S. Cl. ..... 84/291; 84/294

[58] Field of Search ..... 84/1.16, 291, 293, 294

[56] References Cited

U.S. PATENT DOCUMENTS

| | | | |
|---|---|---|---|
| 3,130,625 | 4/1964 | Savona | 84/267 |
| 3,657,462 | 4/1972 | Robinson | 84/1.16 |
| 3,769,871 | 11/1973 | Cawthorn | 84/291 |
| 4,126,073 | 11/1978 | Takabayashi | 84/293 |
| 4,201,108 | 5/1980 | Bunker | 84/267 |
| 4,339,981 | 7/1982 | Smith | 84/291 |

*Primary Examiner*—Lawrence R. Franklin

*Attorney, Agent, or Firm*—Lyon & Lyon

[57] ABSTRACT

A stringed musical instrument such as a guitar has a bridge and a nut mounted at spaced locations on a stem, serving to define a plane for strings. A dense member having greater density than the stem is secured thereto in order to increase the duration of sounds generated by the strings. The stem is detachably secured to a body which may be soft with flexibility to conform to the contours of human body in either standing or sitting position. The stem may also comprise a hollow shell detachably connected to the stem or dense member.

4 Claims, 5 Drawing Figures

SOFT BODY GUITAR

This invention relates to stringed musical instruments such as, for example, guitars having electrical sound pickup. This invention is directed to improvements over my prior U.S. Pat. No. 4,339,981 granted July 20, 1982. The inventive feature of the present application is concerned with the inclusion of a "density plate" enclosed within the body and secured to the stem which carries a bridge, a nut and the strings. This density plate is preferably formed of metal and in any event has a greater density than the stem which is ordinarily made of wood. The effect of this density plate is to prolong the duration of the sound emitted by the strings, or in parlance of the art, it improves the "sustain".

Another feature of the present invention concerns the use of a soft body for a guitar of this type.

Another feature of the present invention resides in the manner of employing a stiffener element adjacent the density plate and having side portions projecting into the joint between split halves of the body. The stiffener element may also add to the sustain effect.

Another feature concerns a novel demountable body.

Other and more detailed objects and advantages will appear hereinafter.

Figure 1:
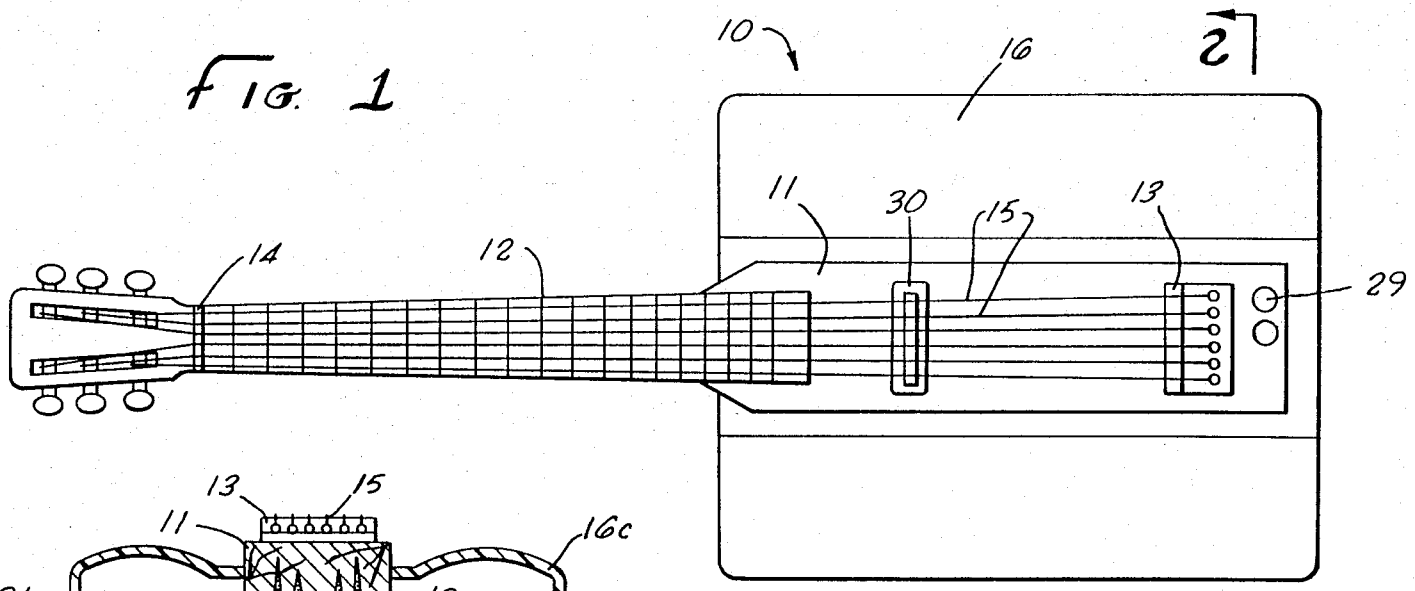
FIG. 1 is a top plan view showing a preferred embodiment of this invention.
Figure 3:
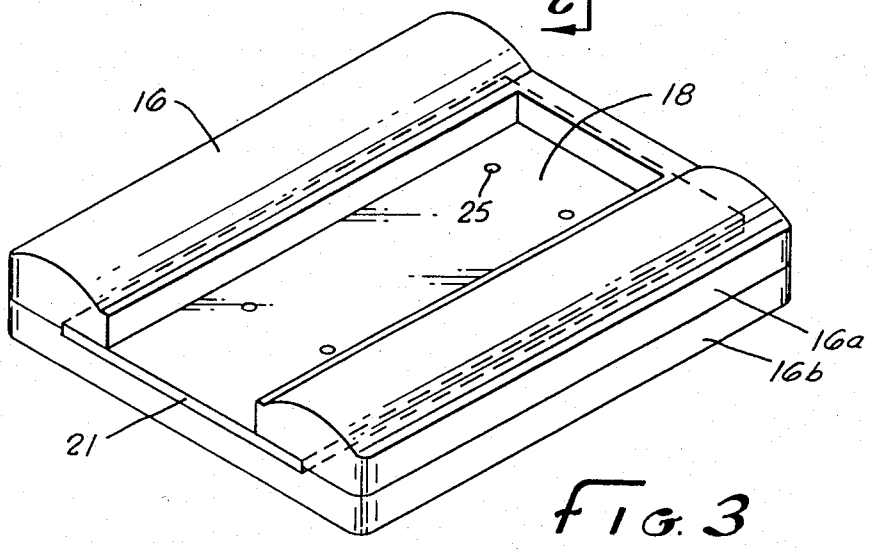
FIG. 3 is a perspective view showing a soft foam body and stiffener element prior to installation of the stem.
Figure 2:
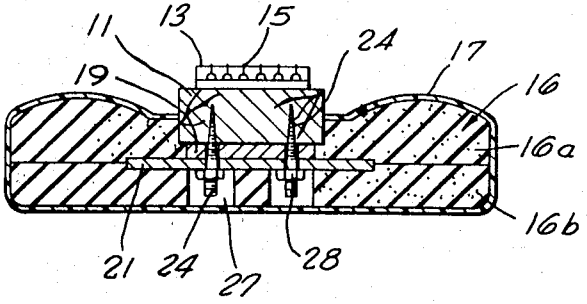
FIG. 2 is a sectional elevation taken substantially on the lines 2—2 as shown in FIG. 1.

Referring to FIGS. 1–4 of the drawings, the stringed musical instrument generally designated 10 may take the form of a guitar having a stem 11 which includes the neck 12, both preferably formed of wood. The stem 11 and neck 12 may constitute a single integral piece, or may comprise two parts fixed together. The bridge 13 and the nut 14 are carried on the stem 11 and define a plane for strings 15.

In accordance with the preferred embodiment of this invention, a soft support member generally designated 16 has flexibility to conform to the contours of a human body in either standing or sitting position. The soft support member 16 has an internal soft structure such as foam, which maintains its overall shape and thickness with or without an enclosing flexible sheath 17. An open top cavity 18 is preferably formed in the support member 16 and is shaped to receive the stem 11. The cavity 18 can be omitted, if desired.

A density plate 19 formed of metal or other dense material is secured to the underside of the stem 11 and enclosed within the upper half 16*a* of the split support member 16. This density member or plate 19 increases the sustain characteristic by prolonging the time of duration of the sound of the strings 15. A stiffener element 21 which may or may not be more dense than the stem 11 is received between the split halves 16*a* and 16*b* of the soft support member 16. The stiffener element 21 is secured to the density plate 19 and extends laterally on each side thereof in the joint between the upper and lower parts 16*a* and 16*b* of the soft support member 16. A suitable adhesive may be employed to join the parts 16*a* and 16*b*, as well as to join these parts to the stiffener element 21. Fasteners 22 extend through openings 23 in the density plate 19 to secure the density plate to the underside of the stem 11. Furthermore, additional fasteners 24 extend through aligned openings 25 and 26 in order to detachably secure the stiffener element 21 in position. Openings 27 are provided in the sheath 17 and the lower part 16*b* of the soft support member to gain access to the fasteners 22, 24 and to the clamping nuts 28.

Control knobs 29 are mounted in a convenient location on the stem 11 for controlling the conventional electrical pickup unit 30 for the sound.

Figure 5:
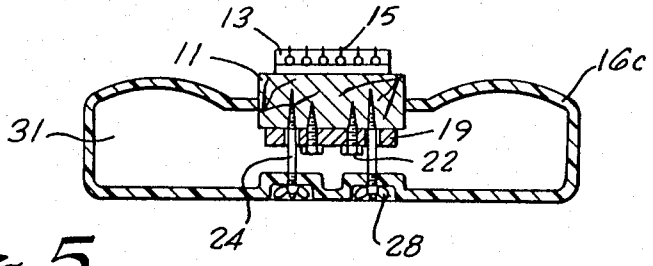
FIG. 5 is a view similar to FIG. 2 showing a modification.
Figure 4:
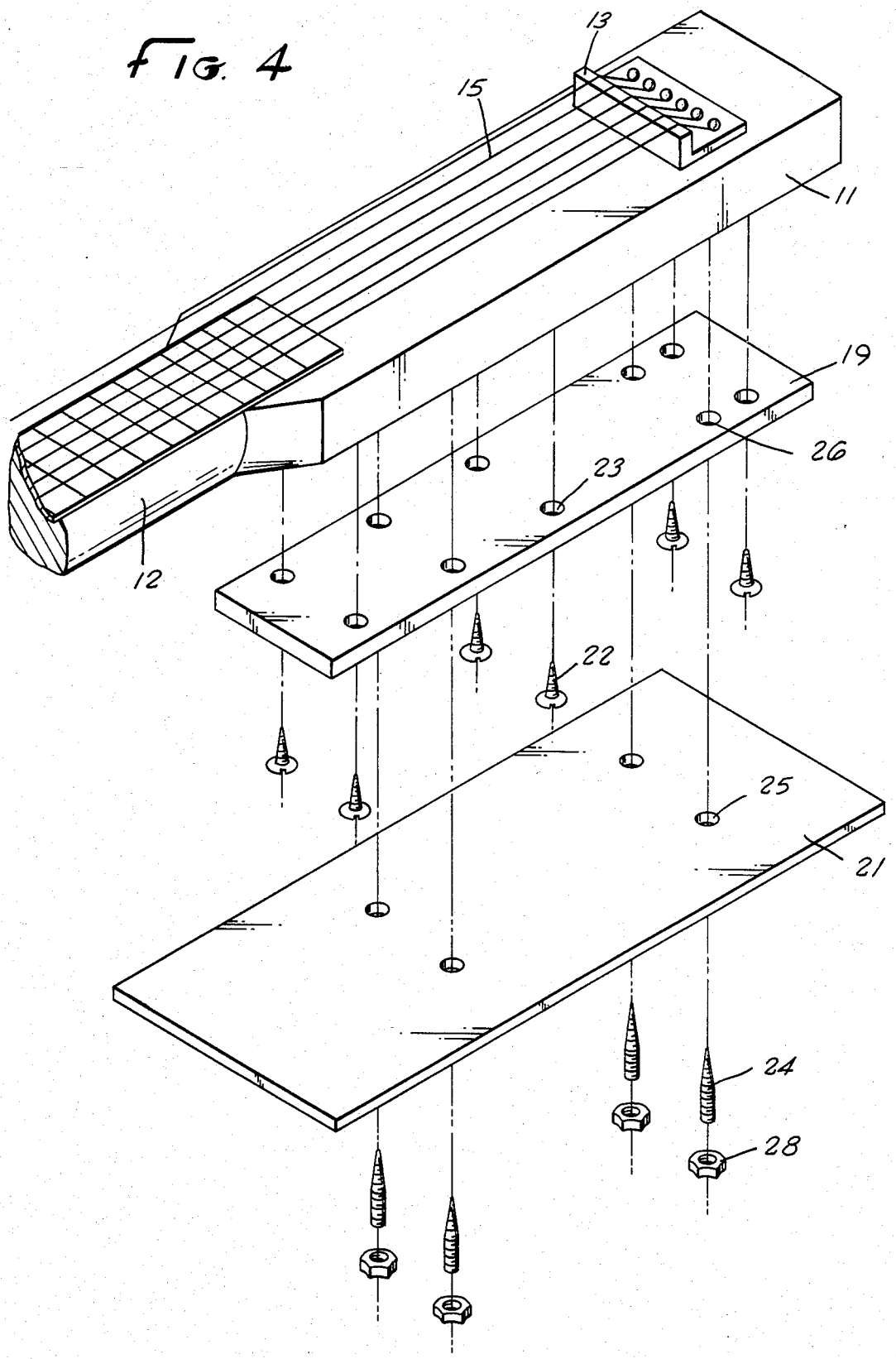
FIG. 4 is an exploded view showing the stem, density plate, and stiffener element prior to assembly.

In the embodiment of this invention shown in FIG. 5, the body 16*c* may be hollow and formed as a plastic shell which is not soft. There may be one central chamber 31 or more than one. The stem 11 and plate 19 are secured together by fasteners 22 in order to achieve the "sustain" feature, and both are detachably secured to the hollow body 16*c* by parts 22 and 28. Some musicians prefer to change the color or style or shape of the body while retaining the same stem, strings, sound equipment, and the detachable feature facilitates this change, when desired.

Having fully described my invention, it is to be understood that I am not to be limited to the details herein set forth but that my invention is of the full scope of the appended claims.

I claim:

1. In a musical stringed instrument, the combination of: a stem, a bridge and a nut mounted at spaced locations on said stem and defining a plane for strings, a soft support member having flexibility to conform to the contours of a human body in either standing or sitting position, the support member having internal soft structure maintaining its overall shape and thickness, a plate member having greater density than said stem and secured thereto at a location enclosed within said soft support member, and a stiffener element secured relative to said plate member and having laterally extending portions, said soft support member being divided to receive said laterally extending portions.

2. The combination set forth in claim 1 in which the stem is formed of wood and the plate member is formed of metal.

3. The combination set forth in claim 1 in which the soft support member is composed of foam material enclosed by a flexible sheath.

4. In a musical stringed instrument, the combination of: a stem formed of wood, a bridge and a nut mounted at spaced locations on said stem and defining a plane for strings, a soft pillow-like foam member constructed to maintain its overall shape and thickness, a metal plate member secured to said stem at a location enclosed within said soft support member, and a stiffener element formed of wood and secured relative to said metal plate member and having laterally extending portions, said soft support member being divided to receive said laterally extending portions.

* * * * *